US007874106B2

(12) United States Patent
Pangburn et al.

(10) Patent No.: US 7,874,106 B2
(45) Date of Patent: Jan. 25, 2011

(54) SILL FLASHING AND END DAM ASSEMBLY

(75) Inventors: Donald G. Pangburn, McDonough, GA (US); Richard Braunstein, Marietta, GA (US)

(73) Assignee: YKK Corporation of America, Marietta, GA (US)

( * ) Notice: Subject to any disclaimer, the term of this patent is extended or adjusted under 35 U.S.C. 154(b) by 164 days.

(21) Appl. No.: 12/370,894

(22) Filed: Feb. 13, 2009

(65) Prior Publication Data

US 2010/0205869 A1 Aug. 19, 2010

(51) Int. Cl.
*E06B 1/70* (2006.01)

(52) U.S. Cl. ..... 52/60; 52/211; 52/52; 52/212; 52/745.19; 49/467; 29/464; 29/525.11; 29/525.01

(58) Field of Classification Search ..... 52/60, 52/211, 212; 405/42; 49/467
See application file for complete search history.

(56) References Cited

U.S. PATENT DOCUMENTS

| | | | | |
|---|---|---|---|---|
| 3,798,863 | A | 3/1974 | Latson | |
| 4,194,284 | A * | 3/1980 | Diels et al. | 29/509 |
| 4,250,673 | A | 2/1981 | Hubbard | |
| 4,407,097 | A * | 10/1983 | Allen | 52/11 |
| 4,448,001 | A | 5/1984 | Whitmyer et al. | |
| 4,555,882 | A | 12/1985 | Moffitt et al. | |
| 4,621,471 | A * | 11/1986 | Kuhr et al. | 52/288.1 |
| 4,747,248 | A * | 5/1988 | Fahs | 52/455 |
| 5,042,199 | A | 8/1991 | Schneider et al. | |
| 5,136,814 | A * | 8/1992 | Headrick | 49/468 |
| 5,542,217 | A | 8/1996 | Larivee, Jr. | |
| 5,815,986 | A | 10/1998 | Laska | |
| 5,889,026 | A | 3/1999 | Alanine et al. | |
| 6,301,849 | B1 | 10/2001 | Roth | |

(Continued)

FOREIGN PATENT DOCUMENTS

| | | |
|---|---|---|
| EP | 1533436 | 5/2005 |

(Continued)

OTHER PUBLICATIONS

Lies, Kenneth M. and Brian A. Faith, "Window Detailing Considerations for Leakage Prevention", *Water Leakage Through Building Facades, ASTM STP 1314*, R.J. Kudder and J. L. Erdly, Eds. American Society for Testing and Materials, 1998, pp. 33-46.

*Primary Examiner*—Robert J Canfield
(74) *Attorney, Agent, or Firm*—Kilpatrick Stockton LLP

(57) ABSTRACT

Various embodiments of the invention are directed to a sill flashing assembly configured to fit within a lower portion of an opening in a wall. The sill flashing assembly comprises: (1) a central sill flashing member having a substantially horizontal portion and a substantially vertical portion; and (2) at least one end dam member. The substantially vertical portion extends upwardly adjacent an interior edge of the substantially horizontal portion, and the substantially vertical portion defines at least one channel. The end dam member has a planar base and at least one tab extending at an angle greater than zero degrees from an interior edge of the planar base. The tab has a height that is shorter than a height of the interior edge of the planar base, and the tab engages the channel when the end dam member is installed adjacent an end of the central sill flashing member.

24 Claims, 9 Drawing Sheets

U.S. PATENT DOCUMENTS

| | | | | |
|---|---|---|---|---|
| 6,401,401 | B1 | 6/2002 | Williams | |
| 6,401,402 | B1 | 6/2002 | Williams | |
| 6,412,240 | B1 | 7/2002 | Treleven et al. | |
| 6,540,437 | B1 | 4/2003 | Larson | |
| 6,725,610 | B2 | 4/2004 | Murphy et al. | |
| 6,802,171 | B2 | 10/2004 | McKinnon | |
| 6,931,792 | B2 * | 8/2005 | McDonald et al. | 52/12 |
| 6,964,136 | B2 | 11/2005 | Collins et al. | |
| 7,134,245 | B2 | 11/2006 | Burton | |
| 7,222,462 | B2 | 5/2007 | Ellingson | |
| 7,290,379 | B2 | 11/2007 | Allen | |
| 7,367,164 | B2 | 5/2008 | Burton et al. | |
| 7,676,996 | B2 * | 3/2010 | Teodorovich | 52/204.2 |
| 7,694,472 | B2 * | 4/2010 | Rawlings | 52/210 |
| 2003/0005644 | A1 * | 1/2003 | Reithmeyer et al. | 49/467 |
| 2003/0106269 | A1 * | 6/2003 | Bauman et al. | 49/467 |
| 2003/0213193 | A1 * | 11/2003 | Carroll et al. | 52/238.1 |
| 2005/0055912 | A1 | 3/2005 | Teodorovich | |
| 2005/0108951 | A1 * | 5/2005 | McDonald et al. | 52/11 |
| 2005/0268569 | A1 | 12/2005 | Teodorovich | |
| 2005/0279044 | A1 | 12/2005 | Mileti et al. | |
| 2006/0101726 | A1 | 5/2006 | Collins | |
| 2006/0143996 | A1 | 7/2006 | Alvarado | |
| 2006/0283101 | A1 | 12/2006 | Sourlis | |
| 2007/0289226 | A1 | 12/2007 | Lokkart | |
| 2008/0060289 | A1 | 3/2008 | Shah et al. | |
| 2008/0141602 | A1 | 6/2008 | Allen | |
| 2009/0272045 | A1 * | 11/2009 | Teodorovich | 52/58 |

FOREIGN PATENT DOCUMENTS

| | | | |
|---|---|---|---|
| GB | 2 147 647 | A * | 5/1985 |
| WO | WO01/71142 | | 9/2001 |
| WO | WO2005/118996 | | 12/2005 |
| WO | WO/2008041865 | | 4/2008 |

* cited by examiner

SILL FLASHING AND END DAM ASSEMBLY

BACKGROUND OF THE INVENTION

Sill flashing is commonly used at the base of a building window to carry water draining from the window's framing system to the exterior of the building. The sill flashing is positioned beneath window framing, and end dams disposed at the ends of the sill flashing prevent water from draining from the side edges of the sill flashing into a building's wall cavity. FIG. 8 illustrates a conventional end dam and sill flashing assembly 800. Typically, the end dams 810 are L-shaped, having a horizontal portion 815 and a vertical portion 820, and are secured to the sill flashing 850 by engaging a threaded fastener 860 through the bottom of the sill flashing and into the horizontal portion 815 of the L-shaped end dam 810. To create a water tight seal, sealant is applied to the fastener holes 860 in the bottom of the sill flashing 850 and end dams 810 and between the ends of the flashing 850 and the vertical portion 820 of the end dams 810.

End dams affixed to sill flashing in this manner, however, are prone to leakage. The seals created at the holes through the sill flashing and end dams often break under the stresses of the window's assembly. In addition, the seals between the ends of the sill flashing and the end dams are relatively weak due to the lack supporting structure and are vulnerable to separation.

Accordingly, there is a need in the art for an improved sill flashing assembly that is more durable and water resistant.

BRIEF SUMMARY OF THE INVENTION

Various embodiments of the invention are directed to a sill flashing assembly configured to fit within a lower portion of an opening in a wall. The sill flashing assembly comprises: (1) a central sill flashing member having a substantially horizontal portion and a substantially vertical portion; and (2) at least one end dam member. The substantially vertical portion extends upwardly adjacent an interior edge of the substantially horizontal portion, and the substantially vertical portion defines at least one channel. The end dam member has a planar base and at least one tab extending at an angle greater than zero degrees from an interior edge of the planar base. The tab has a height that is shorter than a height of the interior edge of the planar base, and the tab engages the channel when the end dam member is installed adjacent an end of the central sill flashing member.

In certain embodiments, the central sill flashing member may further include one or more openings, and the end dam member may further include one or more apertures. The one or more openings and the one or more apertures are aligned when the tab of the end dam member engages the channel. In addition, in certain embodiments, the channel of the central sill flashing member may be disposed on the substantially horizontal portion of the central sill flashing member, rather than the vertical portion.

BRIEF DESCRIPTION OF THE SEVERAL VIEWS OF THE DRAWING(S)

Having thus described various embodiments of the invention in general terms, reference will now be made to the accompanying drawings, which are not necessarily drawn to scale, and wherein:

DETAILED DESCRIPTION OF VARIOUS EMBODIMENTS OF THE INVENTION

Various embodiments of the present invention now will be described more fully hereinafter with reference to the accompanying drawings, in which some, but not all embodiments of the inventions are shown. These inventions may be embodied in many different forms and should not be construed as limited to the embodiments set forth herein. Rather, these embodiments are provided so that this disclosure will satisfy applicable legal requirements. Like numbers refer to like elements throughout.

Various embodiments of a sill flashing assembly include at least one end dam member that can be secured to an end of a central sill flashing member without the need for holes extending through the bottom of the central sill flashing member. For example, in various embodiments, the central sill flashing assembly includes at least one generally planar end dam member that attaches adjacent an end of a generally L-shaped central sill flashing member. Together, the central sill flashing member and the end dam member are configured to fit between the lower portion of an opening in a wall and a window frame assembly disposed within the opening.

Figure 1:
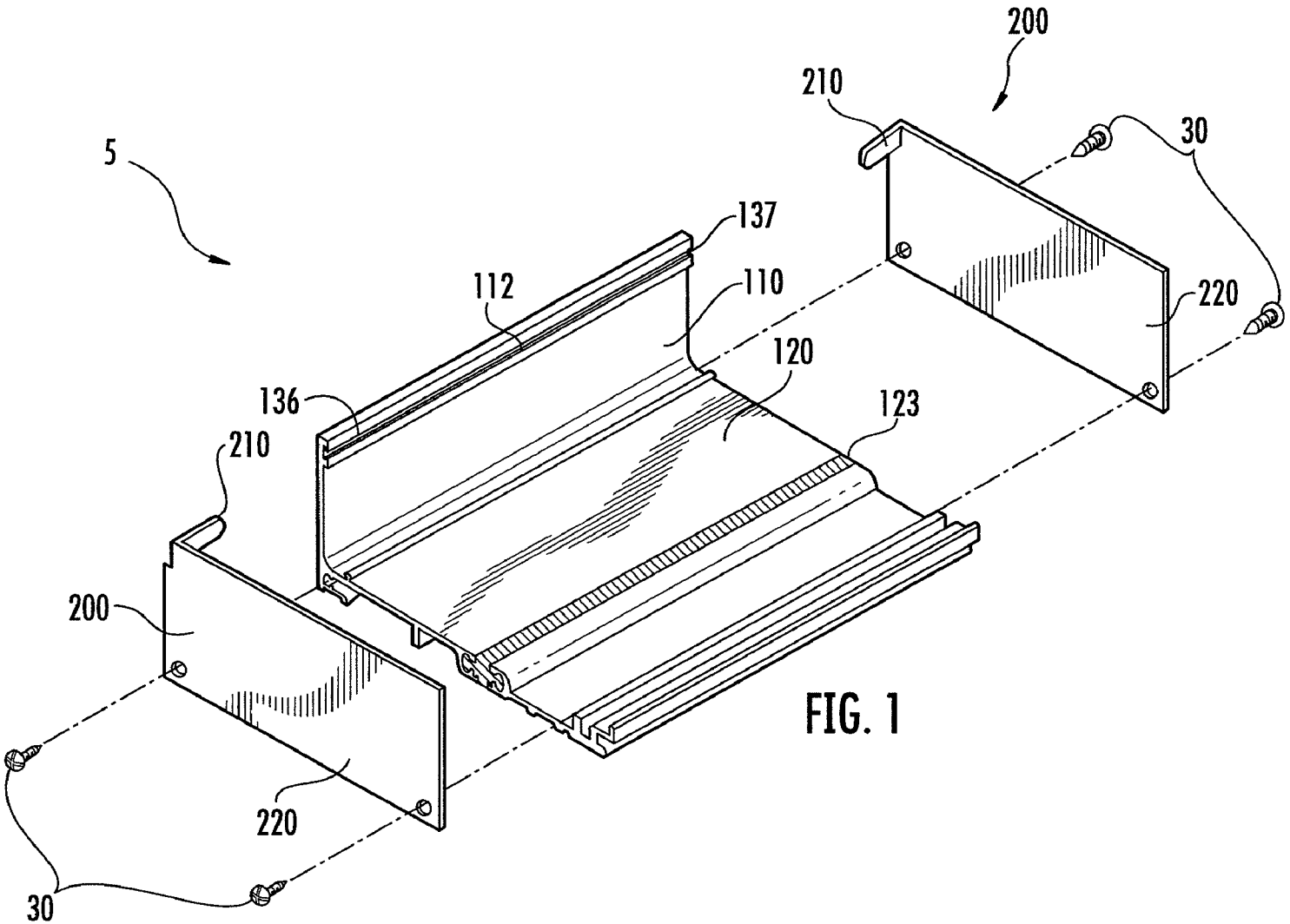
FIG. 1 is an exploded view of a sill flashing assembly according to one embodiment of the invention.

In various embodiments, the end dam member includes at least one tab that extends from an edge of its planar face. The tab is configured to fit within a channel defined on a face of the central sill flashing member. When the tab of the end dam is inserted into the channel of the central sill flashing member, the end dam is disposed flush to the side edge of the central sill flashing member. According to certain embodiments, the end dam member may be further secured to the central sill flashing member by engaging at least one fastener through the end dam member and into at least one opening adjacent the side edge of the central sill flashing member. To further prevent water from leaking between the end dam and the side edge of the central sill flashing member, sealant is applied at the interface of the central sill flashing member and end dam member. For example, an embodiment of the end dam member and the central sill flashing member assembled together is shown in FIG. 1 and is discussed in more detail below.

Each of the sections below describes various embodiments of the central sill flashing member, the end dam member, and methods of assembling the sill flashing assembly.

Central Sill Flashing Member

Figure 3:
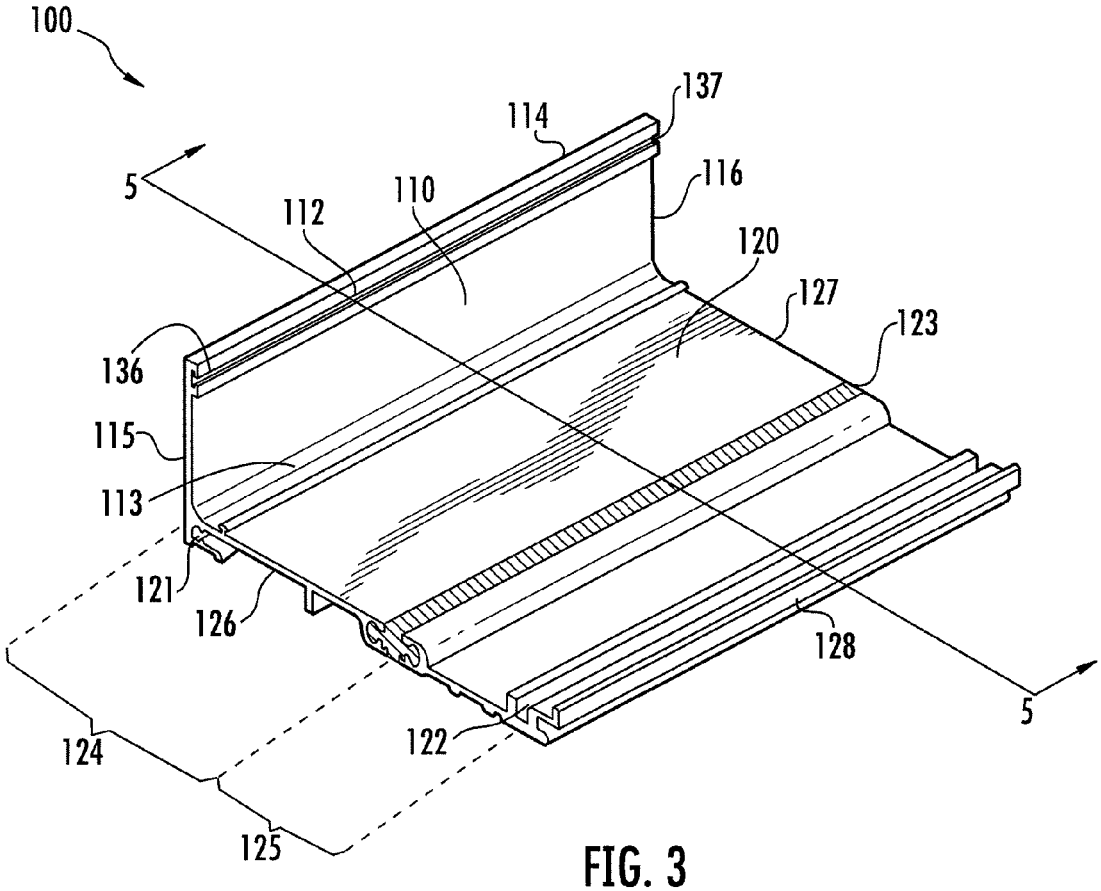
FIG. 3 is a top perspective view of the central sill flashing member shown in FIG. 1.

As discussed above, according to various embodiments, the central sill flashing member includes a substantially vertical portion and a substantially horizontal portion. According to one embodiment, which is shown in FIG. 3, the central sill flashing member 100 includes a substantially vertical portion 110 and a substantially horizontal portion 120. The vertical portion 110 extends upwardly from the horizontal portion 120 from an interior edge 113 of the horizontal portion 120. An upper edge 114 of the vertical portion 110 extends substantially parallel to the interior edge 113 of the horizontal portion 120.

The horizontal portion 120 and the vertical portion 110 form continuous side edges on each end of the horizontal portion 110 and the vertical portion 120. The first continuous side edge includes a first vertical portion side edge 115 and a first horizontal portion side edge 126, and the second continuous side edge includes a second vertical portion side edge 116 and a second horizontal portion side edge 127. In addition, the vertical portion 110 extends length-wise from the first vertical portion side edge 115 to the second vertical portion side edge 116, and the vertical portion side edges 115, 116 are substantially parallel to one another. In addition, the vertical portion 110 extends in a height direction from the interior edge 113 to the upper edge 114 of the vertical portion 110. The horizontal portion 120 extends length-wise from the first horizontal portion side edge 126 to the second horizontal portion side edge 127, which are substantially parallel to one another, and the horizontal portion 120 extends in a width direction from the interior edge 113 to an exterior edge 128.

Figure 5:
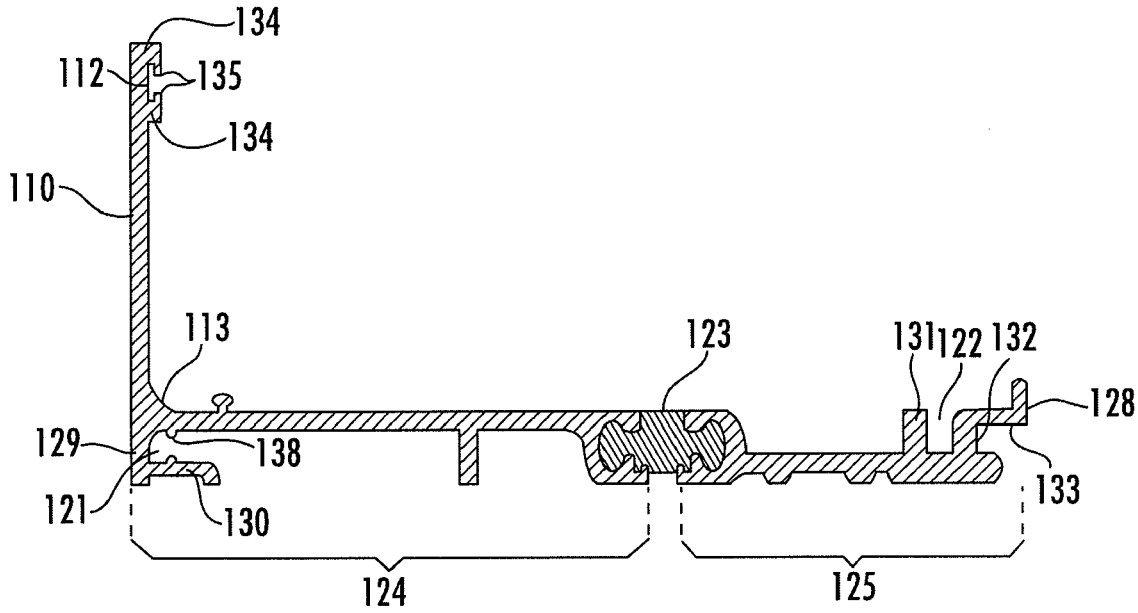
FIG. 5 is a cross-sectional view of the central sill flashing member as viewed from the 5-5 line in FIG. 3.
Figure 11:
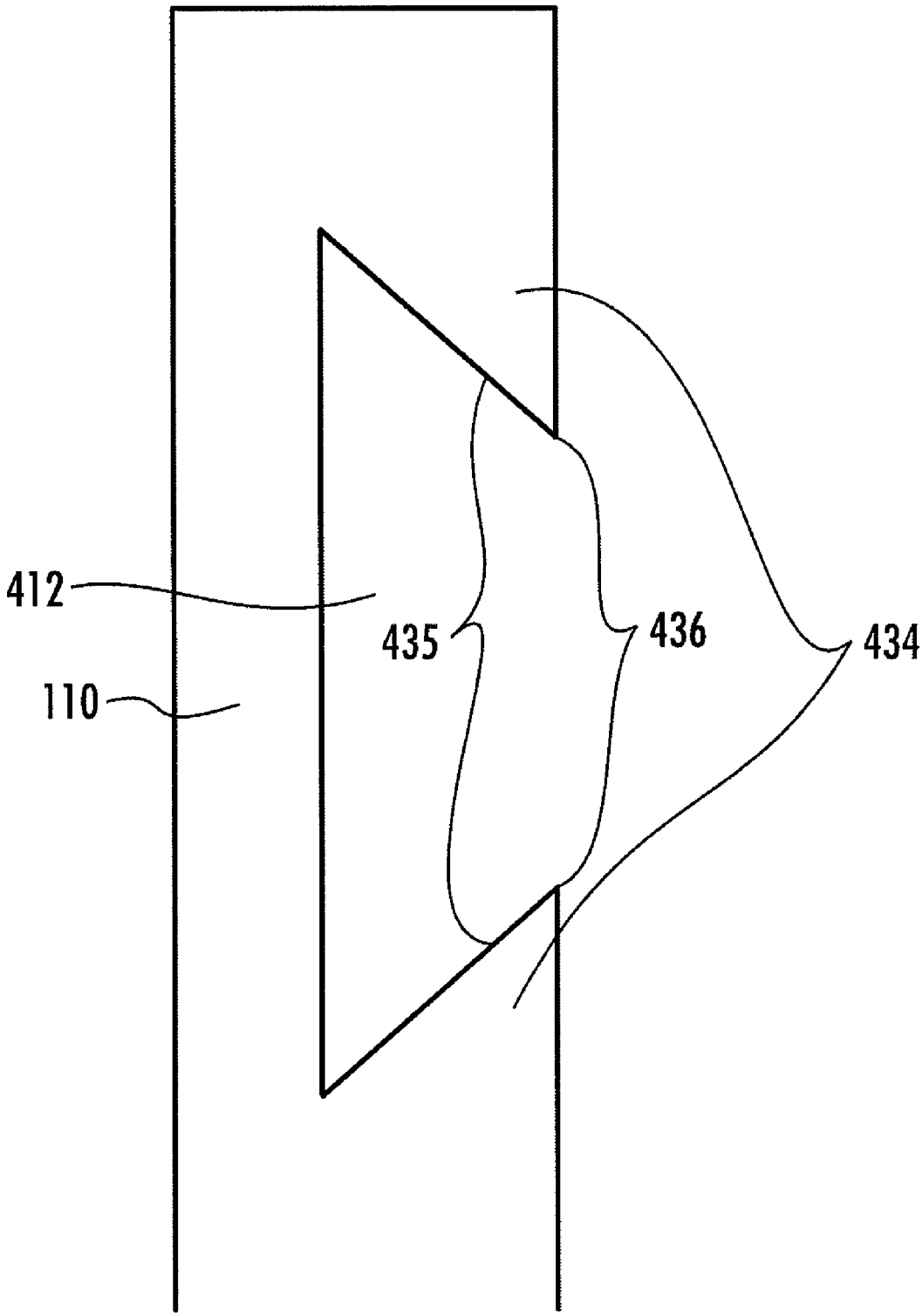
FIG. 11 is a partial end view of an alternative embodiment of a vertical portion channel of a central sill flashing member.

According to various embodiments, the vertical portion 110 of the central sill flashing member 100 includes at least one vertical portion channel 112. For example, in the embodiment shown in FIG. 3, the vertical portion channel 112 is disposed adjacent the upper edge 114 of the vertical portion 110 and extends the length of the vertical portion 110 between the first vertical portion side edge 115 and the second vertical portion side edge 116. As shown in FIG. 5, which illustrates a cross-sectional view of the central sill flashing member 100 as taken through the 5-5 line of FIG. 3, the vertical portion channel 112 includes a pair of substantially parallel walls 134 that extend outwardly from the vertical portion 110, and arms 135 extend from the distal ends of the walls 134 toward each other. The distal ends of the arms 135 define a first opening 136, which extends along the length of the vertical portion 110, and the walls 134 and arms 135 together define a second opening 137 adjacent each side edge 115, 116. In another embodiment, shown in FIG. 11, a vertical portion channel 412 includes a pair of walls 434 that extend outwardly from a vertical portion 110. The walls 434 each have a sloped interior edge 435 that tapers toward the opposing wall 434 such that the vertical portion channel 412 defines a substantially trapezoidal shaped opening at each side edge 115, 116. The distal end of each interior edge 435 defines an opening 436 that extends along the length of the vertical portion 110.

According to various embodiments, such as the embodiment shown in FIG. 3, the horizontal portion 120 of the central sill flashing member 100 includes an interior portion 124 and an exterior portion 125. The interior portion 124 is adjacent the interior edge 113, and the exterior portion 125 is adjacent the exterior edge 127. In certain embodiments, the interior portion 124 and exterior portion 125 are joined together by a thermal break 123. In these embodiments, the thermal break is a member formed from material having relatively low-thermal conductivity as compared to the material from which the horizontal portion 120 is formed and extends the length of the horizontal portion 120. However, in various other embodiments, the horizontal portion 120 does not include the thermal break 123. In such embodiments, the interior portion 124 and exterior portion 125 may be integrally formed or separately formed and joined together.

Figure 4:
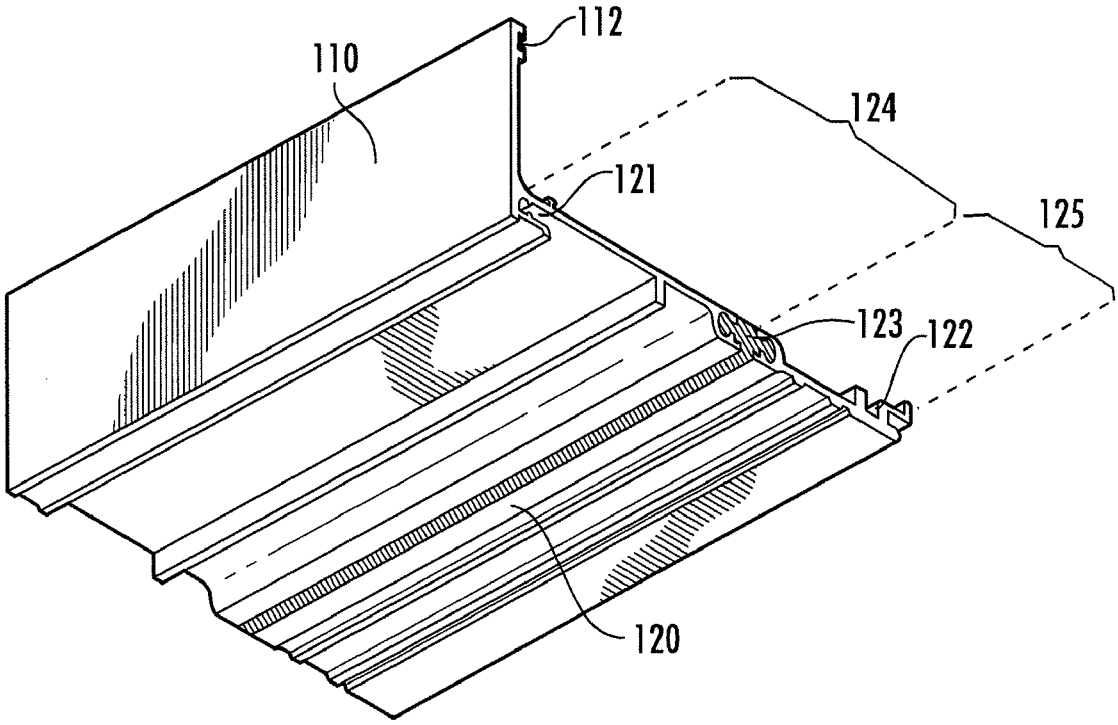
FIG. 4 is a bottom perspective view of the central sill flashing member shown in FIG. 1.

FIGS. 4 and 5 illustrate a further embodiment in which the interior portion 124 defines a first horizontal portion channel 121 and the exterior portion 125 defines a second horizontal portion channel 122. The first horizontal portion channel 121 is disposed adjacent the interior edge 113 and extends the length of the horizontal portion 120 from the first horizontal portion side edge 126 to the second horizontal portion side edge 127. As shown in FIG. 5, the first horizontal portion channel 121 is defined by first and second channel flanges 129, 130 and a portion of the lower surface 138 of the horizontal portion 120. In particular, the first channel flange 129 extends downwardly from a first plane that substantially includes the vertical portion 110. The second channel flange 130 extends outwardly from a bottom edge of the first channel flange 129 in the width direction (i.e., toward the exterior edge 128). In the embodiment shown in FIGS. 4 and 5, at least a portion of the first horizontal portion channel 121 is threaded from each horizontal side edge 126, 127.

Referring back to FIG. 3, the second horizontal portion channel 122 is disposed adjacent the exterior edge 128 and extends the length of the horizontal portion 120. As shown in FIG. 5, the second horizontal portion channel 122 is defined by a third channel flange 131 and a fourth channel flange 132. The third channel flange 131 extends upwardly from the exterior portion 125 inwardly of the exterior edge 127. The fourth channel flange 132 extends upwardly from the exterior portion 125 along the exterior edge 127. In addition, the fourth channel flange 132 includes a lip 133 that extends substantially horizontally from the distal edge of the fourth channel flange 132. In the embodiment shown in FIG. 5, a portion of the second horizontal portion channel 122 is threaded adjacent each horizontal side edge 126, 127.

FIGS. 1 through 5 illustrate one embodiment of the central sill flashing member 100. However, various other embodiments of a central sill flashing member may be suitable for use in the sill flashing and end dam assembly. For example, in the embodiment described above, the vertical portion 110 extends from the interior edge 113 of the horizontal portion 120 at an angle of about 90°. However, in various other embodiments (not shown), the vertical portion may extend at an angle that is greater than or less than about 90° relative to the horizontal portion 120 to accommodate window frame assemblies installed at various orientations or having various shapes. In addition, in the above described embodiments, the vertical portion 110 extends upwardly from the interior edge 113 of the horizontal portion 120, but in other various embodiments (not shown), the vertical portion may extend upwardly from the horizontal portion 120 between the interior edge 113 and the exterior edge 128. For example, in one such alternative embodiment, the central sill flashing member has a T-shaped cross sectional shape instead of an L-shaped cross sectional shape. In addition, the vertical portion 110 and the horizontal portion 120 may be separately formed and assembled together, instead of integrally formed as described above.

In the embodiments described above, the vertical portion channel 112 is disposed adjacent the upper edge 114 of the vertical portion 110 on an exterior surface of the vertical portion 100. However, in other various embodiments, the vertical portion channel may be disposed adjacent a medial portion or a lower portion of the vertical portion 110 and/or on an interior surface of the vertical portion 110. Furthermore, in various other embodiments, the vertical portion 110 may define two or more vertical portion channels. And, other various embodiments may include vertical portion channels that extend a length less than the full length of the vertical portion 110. For example, in one such alternative embodiment, the vertical portion 110 may have one channel extending from its first vertical portion side edge 115 and another channel extending from its second vertical side edge 116. In addition, in other various embodiments, the distal ends of the arms of the vertical portion channel may be serrated or ribbed.

In the embodiments described above, the first and second horizontal portion channel 121, 122 extend the full length of the horizontal portion 120. However, in various other embodiments, these channels 121, 122 may extend less than the full length of the horizontal portion 120. For example, in one such embodiment, the interior portion 124 and the exterior portion 125 each include a horizontal portion channel that extends from the first horizontal portion side edge 126 and a horizontal portion channel that extends from the second horizontal portion side edge 127.

In the embodiment described above in relation to FIGS. 3 and 5, the interior portion 124 and exterior portion 125 each define a channel 121, 122. However, in various other embodiments, each of (or just one of) the interior and exterior portions 124, 125 may instead define an opening therein. In one such embodiment, the openings are circular, threaded openings that extend into the interior portion 124 and exterior portion 125, respectively. And, in various other embodiments, the interior portion 124 and/or exterior portion 125 may define two or more openings and/or channels.

In addition, the embodiment of the first channel flange 129 shown in FIGS. 3 and 5 is described and shown as being substantially disposed within a plane that includes the vertical portion 110, but in various other embodiments, the first channel flange 129 and the second channel flange 130 may be disposed closer to a medial portion of the interior portion 124.

The embodiment of the second horizontal portion channel 122 described above in relation to FIGS. 3 and 5 includes a lip 133, but in other various embodiments, the second horizontal portion channel 122 may not include this lip 133. In addition, in various other embodiments, the second horizontal portion channel 122 may be defined below the plane of the exterior portion 125, similarly to the first horizontal portion channel 121 shown in FIGS. 4 and 5.

According to various embodiments, the central sill flashing member 100 may be constructed from a variety of metal or composite materials having sufficient strength and rigidity. For example, in various embodiments the central sill flashing member 100 is formed of aluminum. In certain embodiments in which the central sill flashing member includes a thermal break, such as thermal break 123 shown in FIGS. 1 and 3 through 5, the thermal break is formed of a material having low thermal conductivity as compared to the material from which the interior and exterior portions 124, 125 of the central sill flashing member 100 are formed. For example, in various embodiments, the thermal break may be formed of glass fiber, nylon polyamide 6/6 with glass fiber, vinyl, acrylonitrile butadiene styrene (ABS), or rigid polyvinyl chloride (PVC).

According to various embodiments, the central sill flashing member may be manufactured by extruding, die casting, or injection molding the necessary components. In embodiments in which the central sill flashing member does not include a thermal break, the entire central sill flashing member may be extruded or die cast as one solid piece. In embodiments in which the central sill flashing member includes a thermal break, portions of the central sill flashing member may be extruded, die cast, or otherwise formed separately and joined attached to the thermal break.

For example, in one embodiment, shown in FIG. 5, the vertical portion 110 and interior portion 124 of the horizontal portion 120 are extruded as one solid piece, and the exterior portion 125 of the horizontal portion 120 is extruded as a separate piece. The thermal break, which is separately formed, is slidably engaged between the exterior portion 125 and the interior portion 124 to join these portions adjacent each other.

End Dam Member

Figure 6:
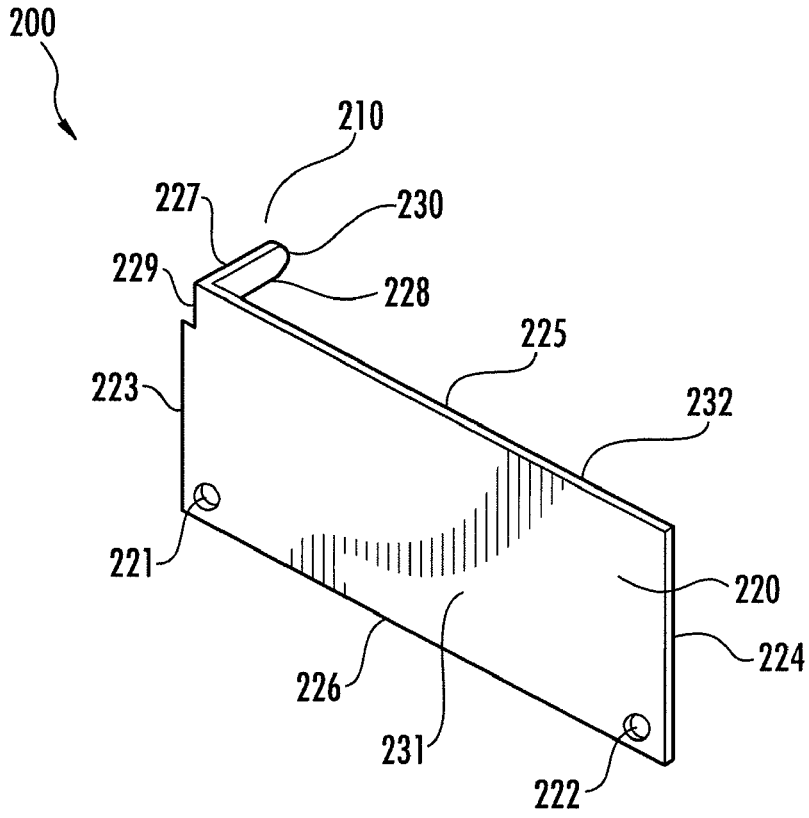
FIG. 6 is a top perspective view of the end dam member shown in FIG. 1.
Figure 7:
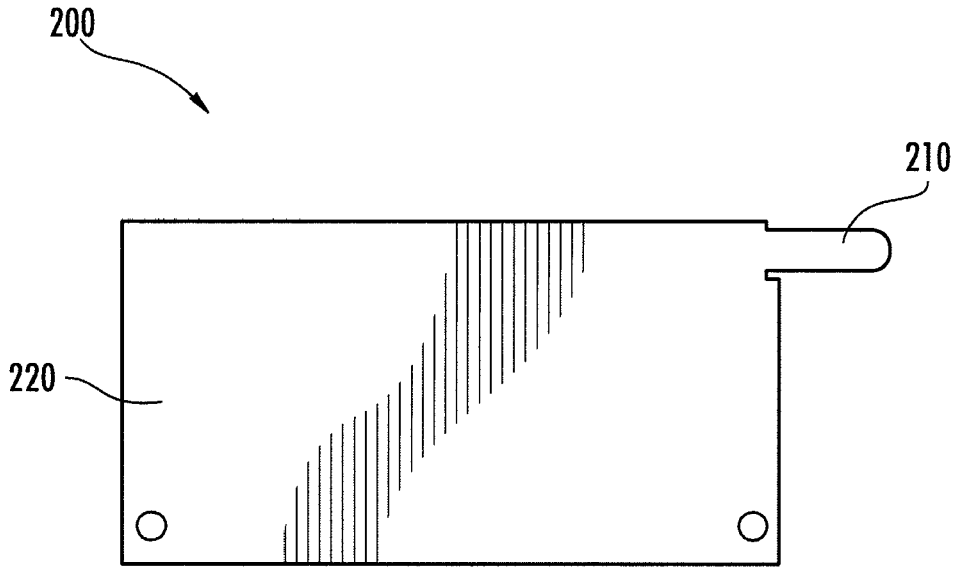
FIG. 7 is a top view of the end dam member shown in FIG. 6 prior to bending the tab.
Figure 8:
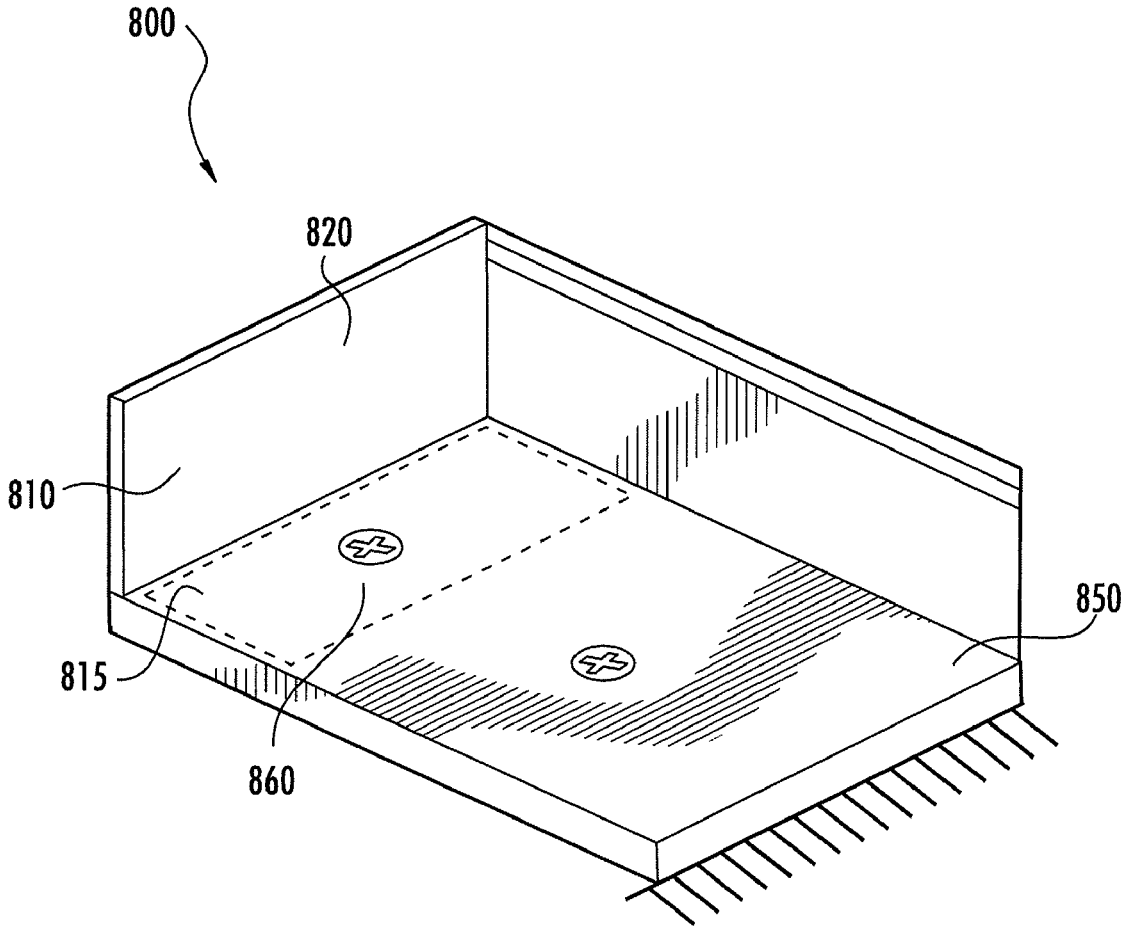
FIG. 8 (PRIOR ART)
FIG. 8 is a perspective view of a prior art sill flashing assembly.

FIG. 6 illustrates a particular embodiment of the end dam member 200. The end dam member 200 includes a planar base 220 having a tab 210 extending from an interior planar base edge 223. The planar base 220 is a generally thin rectangular member having a width defined by the interior planar base edge 223 and an exterior planar base edge 224 and a height defined by a lower planar base edge 226 and upper planar base edge 225. The planar base 220 also includes an interior aperture 221 and an exterior aperture 222, both of which extend through the planar base 220 between an outer surface 231 to an inner surface 232 of the planar base 220.

The tab 210 extends substantially perpendicularly from the interior planar base edge 223 of the planar base 220. The height of the tab 210 is defined by its upper edge 227, which is adjacent the intersection of the interior planar base edge 223 and upper planar base edge 225, and its lower edge 228, which is spaced apart from the upper edge 227 along the interior planar base edge 223. In addition, in the embodiment shown in FIG. 6, the height of the tab 210 gradually decreases from its proximate end 229, adjacent the interior planar base edge 223, to its distal end 230.

Figure 9:
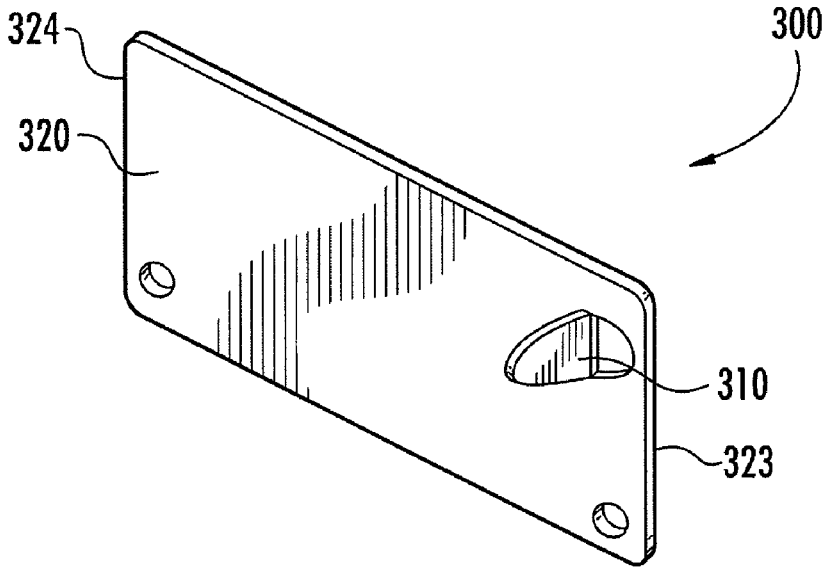
FIG. 9 is a top perspective view of an alternative embodiment of the end dam member.
Figure 10:
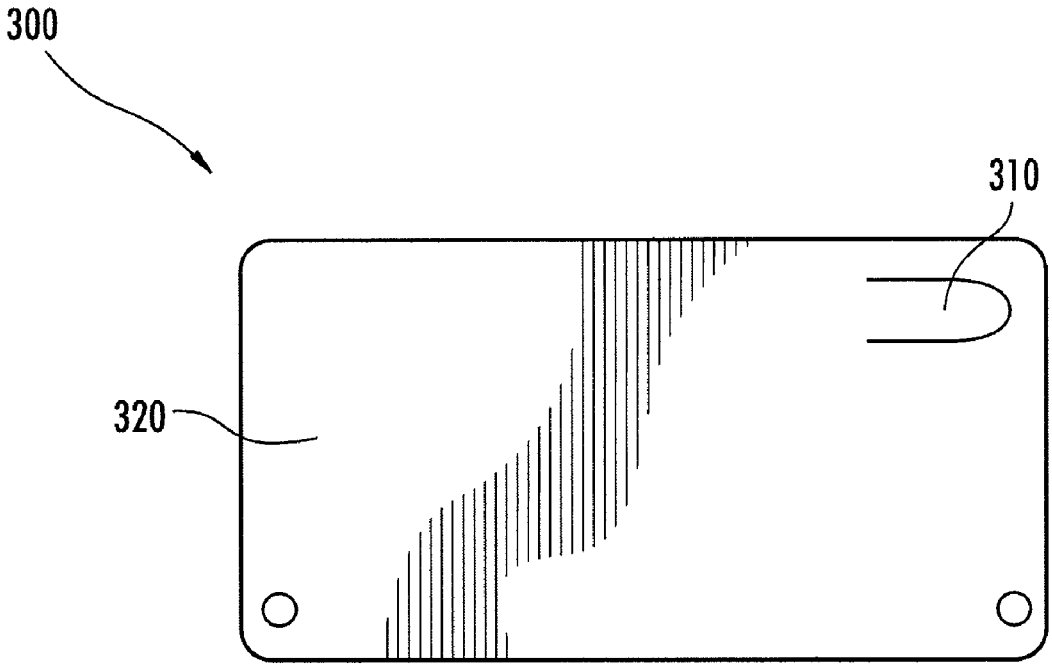
FIG. 10 is a top view of the end dam member shown in FIG. 9 prior to bending the tab.

In other various embodiments, the tab 210 may extend from another portion of the interior planar base edge 223. For example, in one embodiment, the tab 210 may extend from a medial portion of the interior planar base edge 223, and in another embodiment, the tab 210 may extend from a lower portion of the interior planar base edge 223. According to other various embodiments, such as the embodiment shown in FIG. 9, a tab 310 may extend outwardly from a portion of a planar base 320 between an interior planar base edge 323 and an exterior planar base edge 324. As shown in FIG. 10, such an embodiment may be manufactured by die cutting the edges of the tab 310 into the planar base 320 and bending the tab 310 outwardly from the planar base 320. Such an embodiment may also be manufactured by a die or injection molding process as well. In addition, although the planar base 220 shown in FIGS. 1, 2, 6, and 7 is substantially rectangular, various other embodiments may include a planar base having another shape, such as triangular, circular, or other suitable polygonal shape.

According to various embodiments, the end dam member may be constructed from a variety of metal or composite materials having sufficient strength and rigidity. For example, in one embodiment, the end dam member may be formed from a solid piece of aluminum. In addition, according to various embodiments, the end dam member may be manufactured using a variety of metal forming techniques. For example, in the embodiment shown in FIG. 7, the shape of the end dam member 200 is die cut from a sheet of aluminum, and then the tab 210 is bent at a right angle relative to the planar base 220 of the end dam member 200.

Methods of Assembling the Sill Flashing Assembly

A sill flashing assembly according to one embodiment is shown in FIG. 1. The sill flashing assembly 5 includes the embodiment of the central sill flashing member 100 described above in relation to FIGS. 3 through 5 and two end dam members 200 according to the embodiment described above in relation to FIG. 6. The end dam members 200 are secured to each continuous side edge 115, 126 and 116, 127 of the central sill flashing member 100.

In particular, each of the end dam members 200 are secured adjacent a respective continuous side edges 115, 126 and 116, 127 of the central sill flashing member 100 by engaging the tab 210 into the vertical portion channel 112 of the central sill flashing member 100 through the first opening 136 or second opening 137 and engaging a threaded fastener 30 through the apertures 221, 222 of the planar base 220 and into the channels 121, 122 of the horizontal portion 120 of the central sill flashing member 100. Then, sealant or another adhesive substance is disposed adjacent the interface between the central sill flashing member 100 and the planar base 220 to create a water-tight seal.

More specifically, as shown in FIG. 1, the tab 210 has a height substantially similar to the height of the vertical portion channel 112, resulting in a friction fit when the tab 210 engages the vertical portion channel 112. However, in various other embodiments (not shown), the height of the tab may be substantially less than the height of the vertical portion channel 112 and/or the edges of the tab, the edges of the channel, or both may be serrated.

In addition, when the tab 210 is engaged with the vertical portion channel 112 of the central sill flashing member 100, the apertures 221, 222 (shown in FIG. 3) are aligned with the first horizontal portion channel 121 and second horizontal portion channel 122, respectively. Accordingly, fasteners 30 are inserted through the apertures 221, 222 of the planar base 220 and into the first horizontal portion channel 121 and second horizontal portion channel 122. The channels 121, 122 may have a width substantially similar to the diameter of the fasteners 30 such that the fasteners securely engage the sides of the channels 121, 122. In another embodiment, the fasteners 30 and channels 121, 122 may be pre-threaded to create a similar effect.

When the fasteners 30 are tightened, the planar base 220 is compressed against the edges 115, 126 of the central sill flashing member 100. To prevent water from seeping through the interface between the end dam members 200 and the central sill flashing member 100, sealant is disposed along the interface according to one embodiment. According to various other embodiments (not shown), rather than using sealant, a tape material such as butyl tape may be disposed along the interface. In one embodiment, the tape may be pre-attached to portions of the central sill flashing member and/or the end dam member comprising the interface. In such an embodiment, a non-adhesive layer may be peeled from the pre-attached tape exposing an adhesive layer and allowing the central sill flashing member and end dam member to be joined together.

According to another embodiment (not shown), the end dam member may include one or more recesses shaped to mirror the contour of the continuous side edges of the central sill flashing member. In such an embodiment, pre-attached tape or sealant may be disposed within the recesses of the end dam member allowing the end dam member to be adhered to the central sill flashing member. In addition, such an embodiment of the end dam member may be manufactured by die or injection molding.

Although the embodiment described above in relation to FIGS. 1 and 2 describes two separately formed end dam members 200 being secured adjacent the ends of the central sill flashing member 100, in various other embodiments, the central sill flashing member may include a permanent end dam member on one end and require only one end dam member to be secured to the opposite end.

Figure 2:
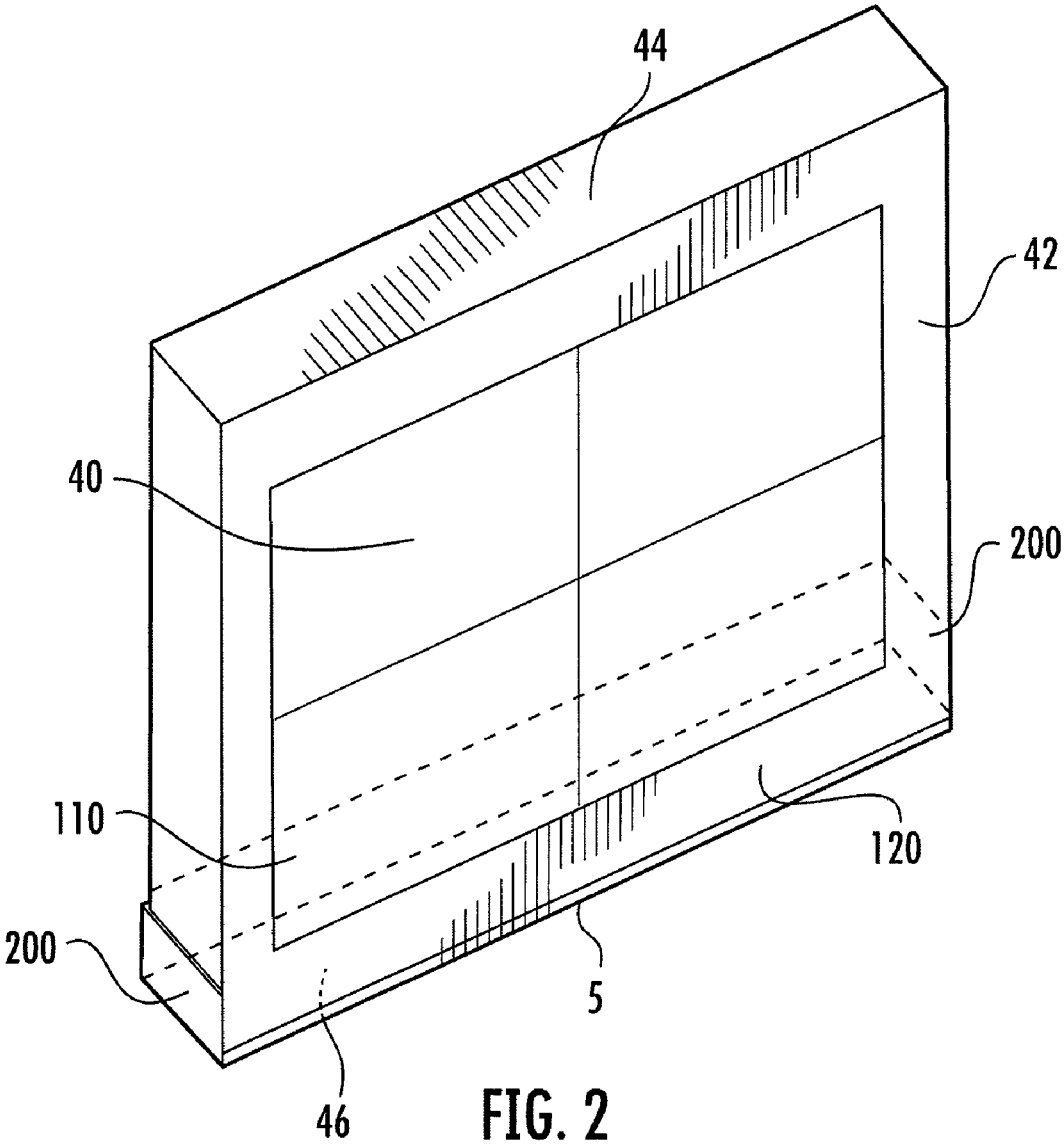
FIG. 2 is a perspective view of an opening in a building wall having the sill flashing assembly shown in FIG. 1 disposed below a window frame assembly according to one embodiment of the invention.

FIG. 2 illustrates the installation of the assembly 5 in a wall opening of a building according to one embodiment. In particular, the sill flashing assembly 5 is disposed beneath the window frame assembly 40 such that the interior face 44 of the window frame assembly 40 is adjacent the vertical portion 110 of the central sill flashing member 100 and the bottom surface of the sill 46 of the window frame assembly 40 is adjacent the horizontal portion 120 of the central sill flashing member 100. The two end dam members 200 are disposed adjacent the jambs of the window frame assembly 40 and prevent water from entering a cavity in the building wall from the side edges of the central sill flashing member 100. In addition, the vertical portion 110 prevents water from entering the interior of the building, and the horizontal portion 120 channels water to the exterior face 42 of the window frame assembly 40. As a result, the sill flashing assembly 5 as a whole prevents water draining from the window frame assembly 40 from entering the interior of the building or its walls.

More specifically, the window frame assembly 40 may be disposed onto the central sill flashing member 100 just after applying sealant along the length of the vertical portion 110 so that the sealant spans the interface between the vertical portion 110 and the interior face 44 of the window frame assembly 40. In a particular embodiment, the sealant is applied in and along the vertical portion channel 112.

The embodiments of the sill flashing assembly 5 shown in FIGS. 1 through 6 describe the tab as being disposed adjacent an interior edge of the end dam member and the channel that the tab engages as being disposed on the vertical portion of the central sill flashing member. However, in various other embodiments, the channel is disposed on the horizontal portion of the central sill flashing member rather than the vertical portion. Furthermore, the vertical portion and/or the horizontal portion of the central sill flashing member may define channels and/or openings for receiving fasteners. And, in yet another embodiment, the central sill flashing member may not define any channels or openings for receiving fasteners and instead rely on the sealant to secure the end dam member against the central sill flashing member.

CONCLUSION

Although various embodiments of the invention have been described in specific detail with reference to the disclosed embodiments, it will be understood that many variations and modifications may be effected within the spirit and scope of the invention as described in the appended claims.

That which is claimed:

1. A sill flashing assembly comprising:

a central sill flashing member having a substantially horizontal portion and a substantially vertical portion, the substantially vertical portion extending upwardly adjacent an interior edge of the substantially horizontal portion, and the substantially vertical portion defining at least one channel, and at least one end dam member, the end dam member having a planar base and at least one tab extending at an angle greater than zero degrees from an interior edge of the planar base, the tab having a height that is shorter than a height of the interior edge of the planar base, wherein the tab engages the channel when the end dam member is installed adjacent an end of the central sill flashing member, and wherein the substantially horizontal portion defines at least one opening through the end of the central sill flashing member, and the planar base defines at least one aperture, wherein the aperture and the opening are aligned when the end dam member is installed adjacent the end of the central sill flashing member.

2. The sill flashing assembly of claim 1, wherein the opening is adjacent an interior edge of the substantially horizontal portion of the central sill flashing member.

3. The sill flashing assembly of claim 2 wherein the channel is a first channel and the substantially horizontal portion defines a second channel adjacent an interior edge thereof, the second channel comprising the opening.

4. The sill flashing assembly of claim 1, wherein the opening is adjacent an exterior edge of the substantially horizontal portion of the central sill flashing member.

5. The sill flashing assembly of claim 4 wherein the channel is a first channel and the substantially horizontal portion defines a second channel adjacent an exterior edge thereof, the second channel comprising the opening.

6. The sill flashing assembly of claim 1, wherein the opening is a first opening adjacent an interior edge of the substantially horizontal portion and the substantially horizontal portion defines a second opening adjacent an exterior edge thereof;

wherein the aperture is a first aperture adjacent an interior edge of the substantially horizontal portion and the end dam member defines a second aperture adjacent an exterior edge of the substantially horizontal portion; and wherein the first opening and first aperture aligned and the second opening and second aperture are aligned when the end dam member is installed adjacent the end of the central sill flashing member.

7. The sill flashing assembly of claim 6, wherein the channel is a first channel, the substantially horizontal portion defines a second channel adjacent an interior edge thereof, the second channel comprising the first opening, and the substantially horizontal portion defines a third channel adjacent an exterior edge thereof, the third channel comprising the second opening.

8. The sill flashing assembly of claim 1, wherein the assembly further comprises an elongated fastener, the elongated fastener being engaged in the aperture and the opening to secure the end dam member adjacent the end of the central sill flashing member.

9. The sill flashing assembly of claim 1, wherein the channel is a first channel and the substantially horizontal portion defines a second channel, the second channel comprising the opening.

10. The sill flashing assembly of claim 1, wherein the channel extends along the length of the central sill flashing member.

11. The sill flashing assembly of claim 1, wherein the tab extends at an angle of about 90 degrees from the planar base.

12. The sill flashing assembly of claim 1, wherein the tab is disposed adjacent an upper portion of the planar base.

13. The sill flashing assembly of claim 1, wherein the channel is disposed adjacent an upper edge of the substantially vertical portion.

14. The sill flashing assembly of claim 1, wherein the channel is disposed adjacent a medial portion of the substantially vertical portion.

15. The sill flashing assembly of claim 1, wherein the tab is disposed adjacent a medial portion of the interior edge of the planar base.

16. The sill flashing assembly of claim 1, wherein the tab is disposed adjacent a lower portion of the interior edge of the planar base.

17. The sill flashing assembly of claim 1, wherein the substantially horizontal portion of the central sill flashing member further comprises an interior portion and an exterior portion, wherein a thermal break is disposed between the interior portion and the exterior portion.

18. The sill flashing assembly of claim 17, wherein the thermal break extends substantially the length of the substantially horizontal portion of the central sill flashing member.

19. The sill flashing assembly of claim 1, wherein the height of the tab tapers from a proximate end to a distal end.

20. A method of assembly comprising the steps of:

providing a central sill flashing member having a substantially horizontal portion and a substantially vertical portion, the substantially horizontal portion defining at least one opening, the substantially vertical portion extending upwardly adjacent an interior edge of the substantially horizontal portion, and the substantially vertical portion defining at least one channel;

providing at least one end dam member, the end dam member having a planar base and at least one tab extending at an angle greater than zero degrees from an interior edge of the planar base, the planar base defining at least one aperture and the tab having a length that is shorter than a length of the interior edge of the planar base, wherein the tab engages the channel and wherein the aperture and the opening are aligned when the end dam member is installed adjacent an end of the central sill flashing member;

securing the end dam member adjacent an end of the central sill flashing member by engaging the end dam member's tab into the channel of the central sill flashing member; and providing at least one elongated fastener engaged in the aperture and the opening to secure the end dam member adjacent to the end of the central sill flashing member.

21. The method of assembly of claim 20, further comprising the step of sealing the interface between the interior edge of the end dam member and the vertical portion of the central sill flashing member, and the interface between the bottom edge of the end dam member and horizontal portion of the central sill flashing member.

22. The method of assembly of claim 20, wherein the step of providing a central sill flashing member further comprises extruding the central sill flashing member.

23. A method of assembly comprising the steps of:

providing a central sill flashing member having a substantially horizontal portion and a substantially vertical portion, the substantially vertical portion extending upwardly adjacent an interior edge of the substantially horizontal portion, and the substantially vertical portion defining at least one channel;

providing at least one end dam member, the end dam member having a planar base and at least one tab extending at an angle greater than zero degrees from an interior edge of the planar base, the tab having a length that is shorter than a length of the interior edge of the planar base, wherein the tab engages the channel when the end dam member is installed adjacent an end of the central sill flashing member;

securing the end dam member adjacent an end of the central sill flashing member by engaging the end dam member's tab into the channel of the central sill flashing member;

wherein the step of providing the end dam member further comprises extruding the end dam member, die cutting the shape of the end dam member, and bending the tab of the end dam member to a certain angle relative to the planar base.

24. A sill flashing assembly comprising:

a central sill flashing member having a substantially horizontal portion and a substantially vertical portion, the substantially vertical portion extending upwardly adjacent an interior edge of the substantially horizontal portion, the central sill flashing member defining at least one channel and at least one opening;

at least one end dam member, the end dam member having a planar base, at least one aperture, and at least one tab extending at an angle greater than zero degrees from a first edge of the planar base, the tab having a height that is shorter than a height of the first edge of the planar base; and wherein the tab engages the channel and the opening and the aperture are aligned through a second edge of the planar base adjacent to and intersecting the first edge when the end dam member is installed adjacent an end of the central sill flashing member.

* * * * *

UNITED STATES PATENT AND TRADEMARK OFFICE

CERTIFICATE OF CORRECTION

PATENT NO. : 7,874,106 B2
APPLICATION NO. : 12/370894
DATED : January 25, 2011
INVENTOR(S) : Donald G. Pangburn et al.

It is certified that error appears in the above-identified patent and that said Letters Patent is hereby corrected as shown below:

In column 2, line 21, delete “tab,” and insert -- tab. --, therefor.

In column 9, line 7, in claim 3, delete “claim 2” and insert -- claim 2, --, therefor.

In column 9, line 14, in claim 5, delete “claim 4” and insert -- claim 4, --, therefor.

Signed and Sealed this
Twenty-second Day of March, 2011

David J. Kappos

David J. Kappos
*Director of the United States Patent and Trademark Office*